US007325994B2

(12) United States Patent
Liberatore

(10) Patent No.: US 7,325,994 B2
(45) **Date of Patent: *Feb. 5, 2008**

(54) SPREADER

(76) Inventor: Raymond A. Liberatore, 12143 Punkin Hollow Rd., Bentonville, AR (US) 72712

( * ) Notice: Subject to any disclaimer, the term of this patent is extended or adjusted under 35 U.S.C. 154(b) by 364 days.

This patent is subject to a terminal disclaimer.

(21) Appl. No.: 10/894,428

(22) Filed: Jul. 19, 2004

(65) Prior Publication Data

US 2005/0135869 A1 Jun. 23, 2005

Related U.S. Application Data

(63) Continuation-in-part of application No. 10/810,485, filed on Mar. 26, 2004, and a continuation-in-part of application No. 10/750,447, filed on Dec. 30, 2003, now Pat. No. 7,226,230, and a continuation-in-part of application No. 10/628,097, filed on Jul. 28, 2003, now abandoned.

(51) Int. Cl.

| | |
|---|---|
| ***B05C 11/00*** | (2006.01) |
| ***B43K 1/06*** | (2006.01) |
| ***B43K 23/12*** | (2006.01) |
| ***B43M 11/06*** | (2006.01) |
| ***B65D 25/40*** | (2006.01) |

(52) U.S. Cl. ..... 401/266; 401/265; 401/262; 401/183; 222/566

(58) Field of Classification Search ..... 401/261–266, 401/183–186; 222/566

See application file for complete search history.

(56) References Cited

U.S. PATENT DOCUMENTS

| | | | | |
|---|---|---|---|---|
| 708,709 | A | 9/1902 | Henneberry et al. | |
| 817,890 | A | 4/1906 | Williams | |
| 1,085,566 | A | 1/1914 | Glover | |
| 1,604,786 | A | 10/1926 | Rinaldi | |
| 1,870,841 | A | 8/1932 | Eckert | |
| 1,994,890 | A | 3/1935 | Kallenbach | |
| 2,550,132 | A | 4/1951 | Woods | |
| 2,716,251 | A | 8/1955 | Pearce | |
| 2,804,767 | A * | 9/1957 | Schoen | 401/9 |
| 2,888,695 | A * | 6/1959 | Anderson et al. | 401/266 |
| 2,930,063 | A | 3/1960 | Stull | |
| 2,982,987 | A * | 5/1961 | Knapp | 401/139 |
| 3,063,601 | A | 11/1962 | Hertz | |
| 3,090,071 | A | 5/1963 | Le Brooy | |
| 3,418,059 | A * | 12/1968 | Robe | 401/266 |
| 3,963,357 | A | 6/1976 | Crisp | |
| 4,225,255 | A * | 9/1980 | Braun et al. | 401/137 |
| 4,693,623 | A | 9/1987 | Schwartzman | |

(Continued)

FOREIGN PATENT DOCUMENTS

DE 29 21 633 A1 12/1980

(Continued)

*Primary Examiner*—David J. Walczak
(74) *Attorney, Agent, or Firm*—Myers Wolin, LLC

(57) ABSTRACT

Apparatus for use with a hand manipulable flowable material dispenser, the combination comprising a dispensing nozzle associated with the dispenser to dispense material, and a spreader surface associated with the nozzle whereby the dispenser may be manipulated to cause the spreader surface to spread material dispensed via the nozzle, and the spreader surface can be used to spread material around after it is dispensed.

13 Claims, 11 Drawing Sheets

U.S. PATENT DOCUMENTS

| | | | |
|---|---|---|---|
| 4,844,250 | A | 7/1989 | Holoubek et al. |
| 4,844,917 | A | 7/1989 | DeLorimiere |
| 4,957,226 | A | 9/1990 | Pacia |
| 5,033,650 | A | 7/1991 | Colin et al. |
| 5,097,987 | A | 3/1992 | Liberatore |
| 5,330,075 | A | 7/1994 | Brown, Sr. |
| 5,377,874 | A | 1/1995 | Brown |
| 5,588,560 | A | 12/1996 | Benedict et al. |
| 5,685,457 | A | 11/1997 | Liberatore |
| 5,797,692 | A | 8/1998 | Poole et al. |
| 5,823,387 | A | 10/1998 | Manadanas et al. |
| 5,865,555 | A | 2/1999 | Dawson |
| 5,890,630 | A | 4/1999 | Lobdell |
| 5,902,060 | A | 5/1999 | Rodriguez |
| 5,960,994 | A | 10/1999 | Liberatore |
| 6,045,283 | A | 4/2000 | Velasquez et al. |
| 6,076,712 | A | 6/2000 | Esber et al. |
| 6,153,238 | A | 11/2000 | Shannon |
| 6,247,618 | B1 | 6/2001 | Liberatore |
| 2002/0000441 | A1 | 1/2002 | Redmond |

FOREIGN PATENT DOCUMENTS

| | | |
|---|---|---|
| GB | 1389205 | 4/1975 |

* cited by examiner

SPREADER

CLAIM OF PRIORITY

This application is a continuation in part of U.S. Ser. No. 10/628,097 filed Jul. 28, 2003 now abandoned and U.S. Ser. No. 10/750,447 filed Dec. 30, 2003 now U.S. Pat No. 7,226,230 and U.S. Ser. No. 10/810,485 filed Mar. 26, 2004.

FIELD OF THE INVENTION

The present invention relates to flowable material spreaders for use on hand manipulatable dispensers, and more particularly to spreaders at the nozzle ends of such dispensers.

BACKGROUND OF THE INVENTION

Spreadable foods are common table items and are enjoyed by many all over the world. There are numerous types of foods that can be spread. Typical spreadable foods include peanut butter, frosting, butter, mayonnaise, jelly, ice cream toppings, salad dressing and cream cheese and other edible spreads for use on bread, crackers, and the like. Often, a butter knife, spatula, or other similar device is used to spread the food onto the bread, cracker, or other item. However, these utensils can become lost on or at outdoor celebrations and picnics, or other events, or need to repeatedly dip a spreader knife into a jar. Additionally, material accumulates on the knife and jar edges, as well as crumbs of other materials can accumulate in the jar.

A number of patents have issued related to food dispensers and the like. U.S. Pat. No. 5,377,874 discloses a liquid dispenser for dispensing fluid condiment materials, such as ketchup, mustard and mayonnaise as well as other liquids such as medicated salves, lotions and ointments. The dispenser includes a tubular body with a spherical plunger element connected to a spreader paddle member disposed within a tubular body. Upon external manipulation of the tubular body, the spherical plunger and spreader paddle arrangement is urged toward a dispenser nozzle for release of condiment filling contained therein. The sanitary spreader paddle simultaneously protrudes from within the tubular body as condiment filling is being evacuated. As a result, the user may evacuate the entire volume of condiment filling within the dispenser as well as spread the deposited condiment filling on a food article to be eaten. In a medical application of the invention, the dispenser includes an integral applicator swab which is connected to the spreader paddle and resides within the plunger. The spreader paddle is separated from the plunger to expose the cleansing swab for use on the body.

U.S. Pat. No. 5,330,075 is directed to a food condiment dispenser for dispensing fluid condiment materials, such as ketchup, mustard and mayonnaise. The dispenser includes a tubular body with a spherical plunger element connected to a spreader paddle member disposed within a tubular body. Upon external manipulation of the tubular body, the spherical plunger and spreader paddle arrangement is urged toward a dispenser nozzle for release of condiment filling contained therein. The sanitary spreader paddle simultaneously protrudes from within the tubular body as condiment filling is being evacuated. As a result, the user may evacuate the entire volume of condiment filling within the dispenser as well as spread the deposited condiment filling on a food article to be eaten.

U.S. Pat. No. 4,957,226 is directed to an automatic food dispensing method, apparatus and utensil primarily for use in fast food restaurants, bakeries, and the like. The method and apparatus comprise a pumping system from a supply through a pump in a controlled amount with a reverse action of the pump after the appropriate amount has been dispensed in order to avoid it dripping. Other drip proof arrangements, such as valving are also utilized optionally. The utensil comprises a handle attached to a container and spreading utensil such as a spoon, ladle, or the like, wherein predetermined portions of a food or substance used in a food may be dispensed either continually or as predetermined quantities. The device consists of a spoon or other appropriately shaped utensil attached to a hollow handle which terminates in a non-interfering connection with the interior of the utensil at one end and terminates at the other end in a connection to a food supply source.

U.S. Pat. No. 6,153,238 is directed to a packaged cheese product comprising a hermetically sealed container, preferably a pouch, made out of flexible material; a decorator tip or adaptor therefore inside the container, a cheese product inside the container and a cap for closing the decorator tip when the pouch is partially emptied. The cheese product can be extruded after cuffing the corner off of the pouch and seating the decorator tip in the resulting opening. Cheese in decorative shapes can then be easily applied as a garnish on food items and the pouch can then be re-closed by capping the decorator tip. The cap preferably has a bulb member that fits inside the decorator tip and a skirt member that fits around the outside petals of the preferred decorator tip.

U.S. Pat. No. 4,844,917 is directed to a cake frosting technique and assembly including a disposable frosting bag for home or commercial use to render the frosting or decorating of cakes or other pastries more convenient and expeditious by the complete elimination of the need for expensive and messy heretofore-used large commercial squeeze bags, or manually whipped and spread frosting, or expensive aerosols. The invention contemplates the ready coloring or tinting of the frosting to any desired hue within a wide range with any particular color and further contemplates the imparting of any desired flavoring to the frosting by the separate and conveniently associated provision of the aforesaid disposable bag containing a neutral or white frosting along with a plurality of separate color tint tubes and a plurality of separate flavor taste tubes, whose contents are to be admixed respectively with the base frosting material to achieve a desired blend for the ultimate decorative and taste effects contemplated.

U.S. Patent Publication No. 2002/0000441 discloses an aperture forming structure, which when attached to or integrally formed in dispenser packages for flowable substances allows reclosure and single or multiple uses. The aperture forming structure includes a breakaway tip member of thermoformable plastic. The break away tip includes a hollow protrusion from a surface. The intersection of the hollow protrusion and the surface is a fault line. Rupturing of the fault line creates an aperture from which the contents of the dispenser package may exit. A cap may be integrally formed with the aperture forming structure and detached for protecting the hollow protrusion or for closing the aperture created when the fault line is ruptured. The aperture forming structure can be made by heating a relatively stiff substantially flat thermoformable sheet of and then stretching the sheet to create a first and a second hollow protrusion in a tiered configuration. A rupture line is placed at the intersection of the first and the second protrusions. The sheet may be attached to a pouch or containment member formed from a flexible sheet which contains any flowable substance.

While there have been a number of prior systems directed to food spreaders, none have adequately addressed the need for ease of use and convenience. There is a need for a system to easily, quickly and accurately spread material such as edible substances, being dispensed from containers such as squeeze tubes or bottles.

OBJECTS AND SUMMARY OF THE INVENTION

It is an object of the present invention to provide a spreader that will allow a user to spread a spreadable food item.

It is a further object of the present invention to provide a spreader having a dispensing nozzle associated with the dispenser to dispense said material, and a spreader surface associated with the nozzle whereby the dispenser may be manipulated to cause the spreader surface to spread material dispensed via the nozzle.

It is a further object of the present invention to provide a system in which the spreader is flexible and can be viewed in use.

It is a further object to provide a spreader in which the spreader is dome-shaped.

It is a further object of the present invention to provide a spreader which has a number of orifices, having different shapes and configurations, including dome shapes.

It is yet another object of the present invention to provide a spreader which includes expandable nipples.

It is yet a further object of the present invention to provide a spreader, including a container, having a base and a lid opposite the base, the container capable of holding a spreadable food item; a detachable handle mounted on the container; a plunger, adapted to engage the detachable handle such that when the detachable handle is depressed, the plunger exerts pressure on the spreadable food item in the container; and a dispenser nozzle, mounted on the exterior of the container proximate to the base of the container, in fluid communication with the interior of the container such that the spreadable food item may be forced through the dispenser nozzle, the dispenser nozzle capable of being in a first position or a second position.

In accordance with a first aspect of the present invention, a novel spreader is disclosed. The novel spreader includes a dispensing nozzle associated with the dispenser to dispense said material, and a spreader surface associated with the nozzle whereby the dispenser may be manipulated to cause the spreader surface to spread material dispensed via the nozzle.

In accordance with another aspect of the present invention, a novel spreader is disclosed. The novel spreader includes a container, having a closed end and an open end, capable of holding a spreadable food item, and a nozzle, mounted at the open end of the container, and having an opening in fluid communication with the open end of the container such that the spreadable food item can flow through the opening of the nozzle.

In accordance with yet another aspect of the present invention, a novel spreader/dispenser is disclosed. The novel spreader/dispenser includes a container, having a base and a lid opposite the base, the container capable of holding a spreadable food item; a detachable handle mounted on the container; a plunger, adapted to engage the detachable handle such that when the detachable handle is depressed, the plunger exerts pressure on the spreadable food item in the container; and a dispenser nozzle, mounted on the exterior of the container proximate to the base of the container, in fluid communication with the interior of the container such that the spreadable food item may be forced through the dispenser nozzle, the dispenser nozzle capable of being in a first position or a second position. The nozzles of the present invention can be used to spread a large variety of items in a variety of formats.

BRIEF DESCRIPTION OF THE DRAWINGS

The foregoing summary, as well as the following detailed description of a preferred embodiment of the present invention will be better understood when read with reference to the appended drawings, wherein:

FIG. 4*a* is a spreader flexible dispensing nozzle having a wavy texture;

DETAILED DESCRIPTION OF THE PREFERRED EMBODIMENT

Figure 1:
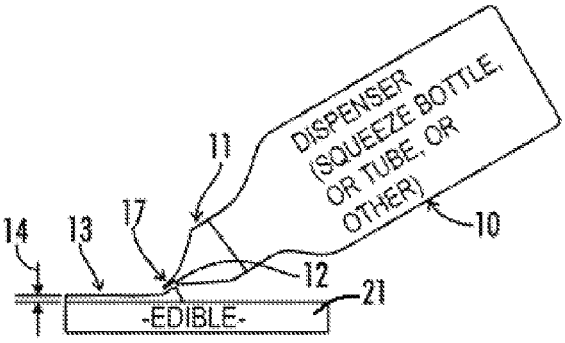
FIG. 1 is a side elevation of a spreader in accordance with the present invention.
Figure 4:
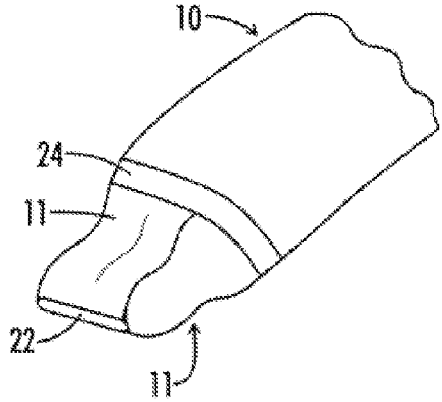
FIG. 4 is a view like FIG. 2 but showing a spreader flexible dispensing nozzle.
Figure 2:
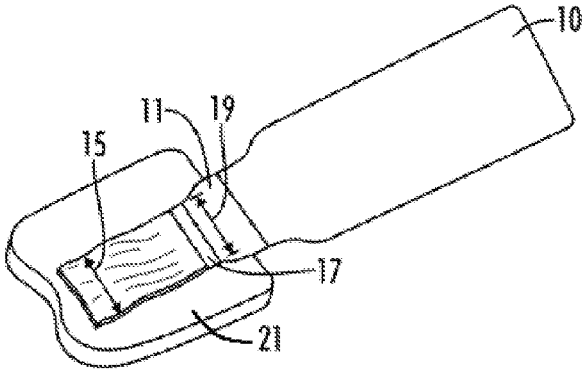
FIG. 2 is a perspective top plan view of the FIG. 1 spreader.
Figure 3:
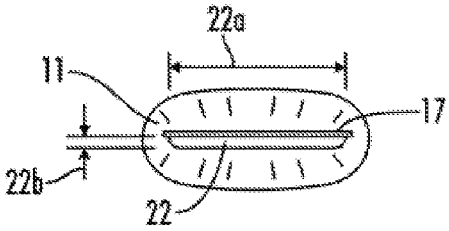
FIG. 3 is a front elevation of a spreader dispensing opening.

Referring now to the drawings, wherein like reference numerals refer to the same components across the several views and in particular to FIGS. 1 and 2, there is shown a spreader 10. The spreader 10 contains dispensable, flowable food material such as peanut butter, jelly or other such edibles. When the container is squeezed, the material flows through a nozzle 11 which tapers toward an outlet 12 which is elongated laterally, to provide a dispensed layer 13 of material of thickness 14 substantially less than its width 15. A flexible spreader 17 in the form of a flap or blade, or spatula, is provided at the nozzle exit, to face the layer 13 exiting from the nozzle, whereby the user can manipulate the spreader, and its undersurface, via container manipulation, to further spread or shape the dispensed layer 13. The flap or blade may be stiff or sufficiently flexible to shape the layer 13. Note its lateral length 19 is substantially greater than its width. The tip of the nozzle or blade should be flexible The nozzle 11 may be stiff or may be flexible as in FIG. 4 to assist flexing of the spreader during container manipulation to cause the spreader to shape the layer 13 deposited on a surface 21 or spread it only after it is dispensed. The latter may be a food surface such as on bread, or other substances. FIG. 3 shows the nozzle outlet 22, which has lateral width 22*a* substantially greater than its thickness 22*b*. The nozzle may be a cap on the container, or may be integral with the container. A snap-on or threaded fitting 24 connects the nozzle to the container, in FIG. 4. As shown in FIG. 4*a*, the extruded product can have a wavy texture.

Figure 5:
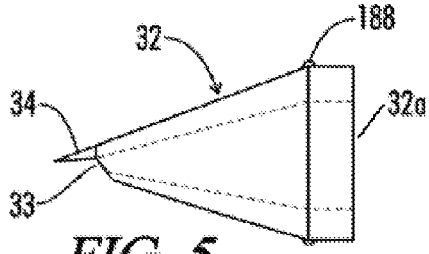
FIG. 5 is a side elevation of a spreader nozzle.
Figure 6:
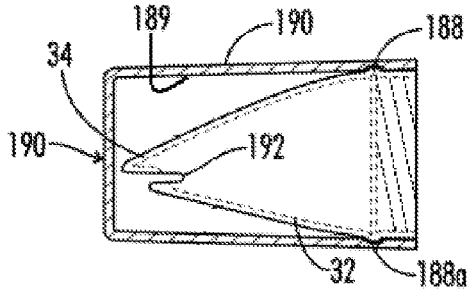
FIG. 6 is a top plan view of a spreader cap.
Figure 7:
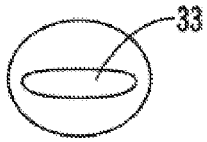
FIG. 7 is a view of an entrance at the inlet end of a spreader as in FIG. 5.
Figure 8:
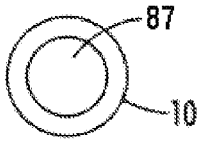
FIG. 8 is like FIG. 7, showing a different entrance configuration.
Figure 9:
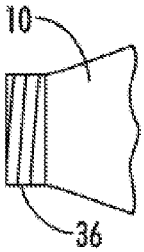
FIG. 9 is a side elevation showing the end of a container to which a spreader cap attaches.
Figure 10:
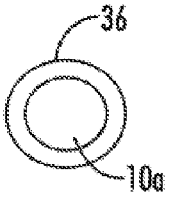
FIG. 10 is a frontal view of the FIG. 9 container end.

FIGS. 5 and 6 show a nozzle 32, tapering toward a narrowed exit 33 with a spreader flap or blade 34 overhanging that exit. FIG. 6 shows a cap 190 that receives the nozzle with snap-ring retention at 188 in a cap recess 188*a* of nozzle end 32*a*. Cap inner wall 189 forms a recess to receive the nozzle. A plug 192 on the cap plugs outlet 33. FIG. 7 shows the exit 33 as laterally, elongated with narrowed width or height. The nozzle entrance is seen at 87, in FIG. 8. FIG. 9 shows dispenser threads 36 to which the nozzle may threadably or otherwise attach. FIG. 10 shows in frontal view the annular end of the thread 36. See end opening 10*a*.

Figure 11:
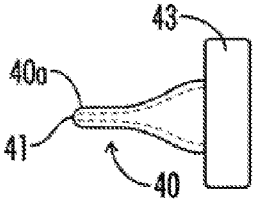
FIG. 11 is a side elevation showing a spreader or narrowed configuration.
Figure 12:
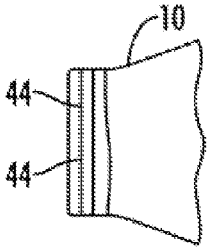
FIG. 12 is a side elevation of the discharge end of a container to which the FIG. 11 spreader attaches.

FIG. 11 shows a flexible nozzle 40 that tapers toward an outlet 41, such as an elongated slit. The nozzle tip 40*a* serves as a spreader and preferably is positioned so that it can be seen when in use. The nozzle has a fitting 43 that threadably attaches to dispenser threads 44, as seen in FIG. 12. Nozzle may alternatively be positioned via a snap and release mechanism.

Figure 13:
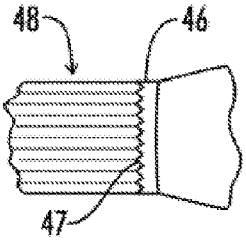
FIG. 13 is a top plan view of a spreader discharge end, with a serrated edge.
Figure 14:
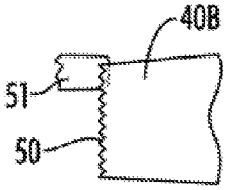
FIG. 14 is a view like FIG. 13 showing a nozzle discharge end with serrated edge.

FIG. 13 shows a spreader flap 46 that has a laterally elongated serrated edge 47 to engage the dispensed layer 48 being dispensed. As a result, the layer 48 has an attractive striated appearance. The nozzle can be waved laterally back and forth to produce wavy elongated striations on the dispensed layer surface. FIG. 14 shows similar serrations 50 on the end of a nozzle 40*b*. A flap 51 can be attached to the nozzle to overlie the serrations, or part of same.

Figure 15:
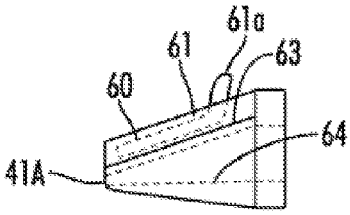
FIG. 15 is a side elevation showing a nozzle with a retracted movable spreader, and control.
Figure 16:
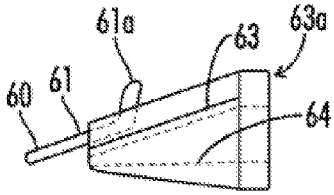
FIG. 16 is a view like FIG. 15, showing the movable spreader in extended position.
Figure 17:
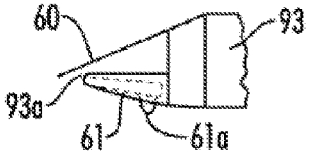
FIG. 17 is like FIG. 15 but showing the movable retractable spreader at the underside of the nozzle.
Figure 18:
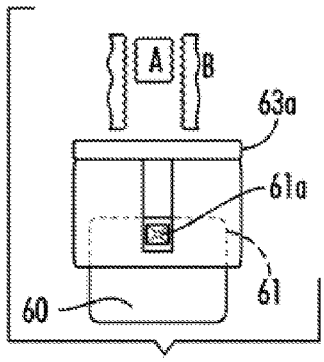
FIG. 18 is a top plan view of a nozzle with an associated retractable and extendable spreader.

In FIG. 15, the flap or blade 60 is carried for adjustable movement, as by a carrier or adjuster 61 on the nozzle. A finger engagable protrusion 61*a* on the carrier is manipulated to move or slide the blade and carrier toward or away from the nozzle exit 41*a*, thereby to adjust the exposure of the blade to the dispensed material, to provide additional flexibility of use of the blade. Grooving 63 in the nozzle in the form of a threaded cap 63*a*, guides the adjuster. FIG. 16 shows the blade in extended forward position. The dispensing nozzle cavity appears at 64. FIG. 18 is a top plan view of the FIG. 16 adjuster. stature 17 shows the adjuster at the bottom side of the nozzle 93, having an exit 93*a* and pusher. The option of depositing the layer 113 without interference with the spreader flap or blade, is preserved.

Figure 19:
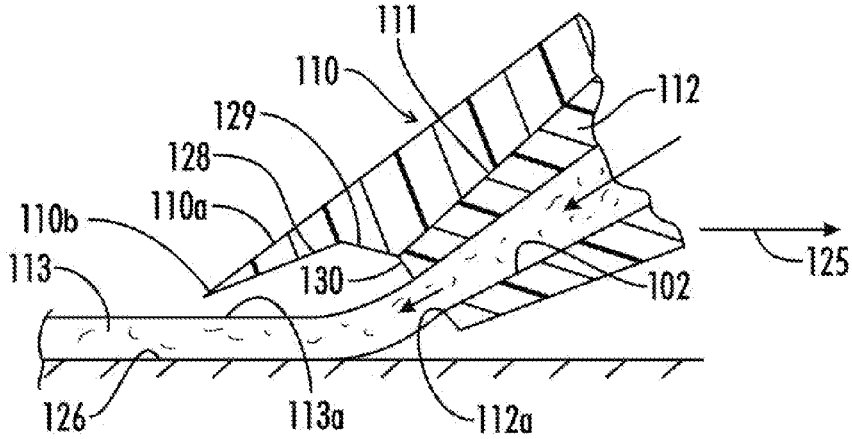
FIG. 19 shows a modified nozzle and spreader.

In FIG. 19 a spreader 110 blade or flap 110*a* carried at 111 by, and may be fixedly or releasably attached to or integral with, a nozzle 112. See bond zone at 111. The spreader and nozzle are shown being moved to the right. See arrow 125, and a layer of dispensable material 113 is deposited on substrate 126, via bore 112*a* of the nozzle. Material 113 is typically edible, and may consist, for example, of peanut butter, butter, frosting, mayonnaise, jam, jelly, soft cheese, or other edibles.

In FIG. 19, the spreader 110 as supported is angled, relative to the nozzle or its bore 102, so that the spreader flap terminal 110*b* is sufficiently offset from the nozzle outlet 112*a* by a sufficient distance, that the terminal tip 110*b* does not engage the top 113*a* of the deposited layer 113, as during depositing of the layer. Terminal 110*b* may consist of an elastomer such as rubber. Outlet 112*a* may be laterally elongated as in FIG. 7.

Figure 19A:
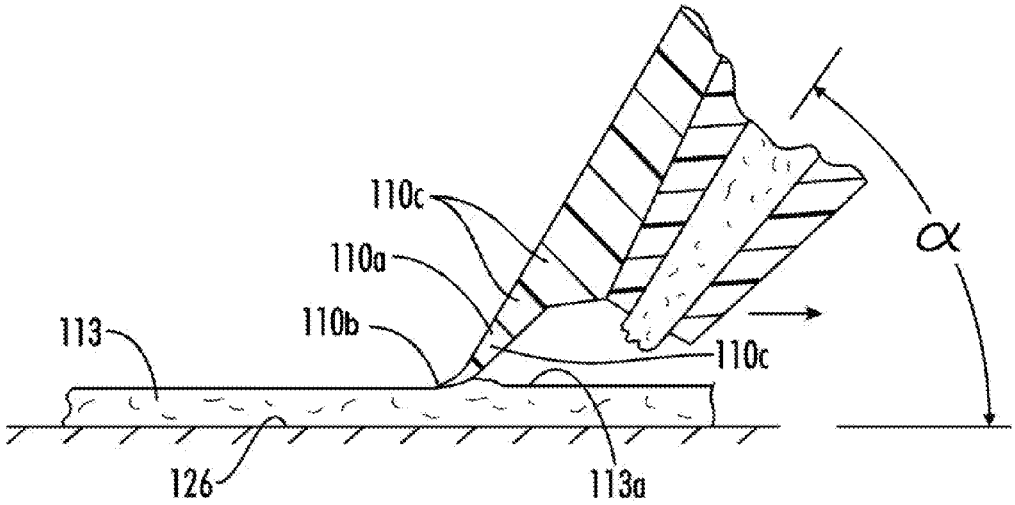
FIG. 19*a* shows the FIG. 19 spreader in tilted position, for spreading use.

In FIG. 19*a* the nozzle is now further tilted, as at angle α, so that the spreader blade terminal tip 110*b* engages the surface of the layer 113, for spreading purposes. Terminal 110*b* is shown as arcuately flexed near the tip, to smoothly engage and spreadably deform surface 113*a*, as the nozzle is moved to the right, relative to 113. Note that the spreader body at 110*c* upwardly of terminal 110*b* is thickened so as not to flex, and so as to positively position the terminal 110*b* as it accurately wipes along surface 113*a*. Terminal 110*b* may or may not be flexible, but is preferably arcuately flexible to smooth and spread surface 113*a*, as the nozzle and supply container are manipulated.

Body 110*c* tapers toward the tip or terminal. This construction, as shown, lends itself to ease of cleaning of interior surfaces 128, 129, and 130, as well as cleaning of the terminal. Note the greater than 90° angularities of adjacent surfaces 128 and 129, and 129 and 130, avoiding small gaps. The spreader terminal at 110*b* may have elongated lateral length, of dimension substantially greater than the nozzle discharge opening dimension, as described above in other FIGURES, for engaging the widened surface area of 113, achieved during spreading.

Figure 20:
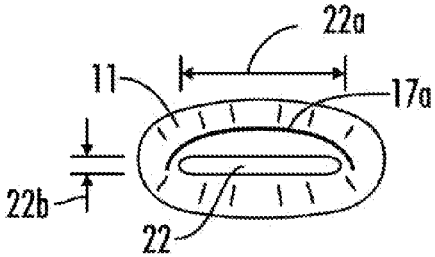
FIG. 20 shows a curved flap or blade.

FIG. 20 shows a curved flap or blade to conform to curvature of an edible, such as a corn cob. See laterally elongated nozzle outlet 22 having narrowed width 22*b*. A downwardly concave spreader flap or blade 17*a* is shown as above the outlet 22, and of lateral elongation greater than outlet 22 lateral elongation, indicated at 22*a*.

Figure 21A:
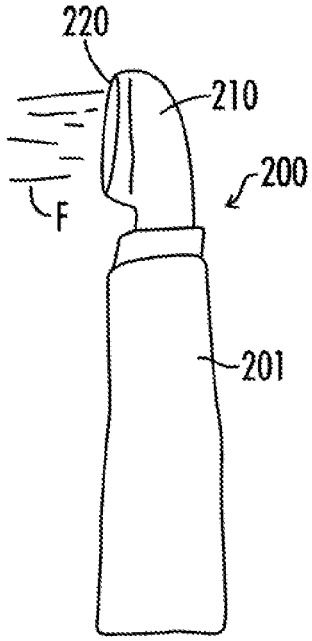
FIG. 21*a* is a side elevation of an alternate embodiment of a spreader outfitted with a knife nozzle in accordance with the present invention.

FIG. 21*a* shows an alternate embodiment of the present invention that combines a knife and a spreader 200. The spreader 200 includes a container 201, that can hold a spreadable food F, such as peanut butter, butter, cheese, and the like. In a preferred embodiment of the present invention, the container 201 is flexible so as to allow a user to squeeze the spreadable food F. A knife nozzle 210 is attached to an open end of the container 201, and has an opening 220 to allow the spreadable food F to be transferred from the container 201 to an item such as bread, crackers, and the like. The knife nozzle 210 can then be used to spread the spreadable food F as desired.

Figure 21B:
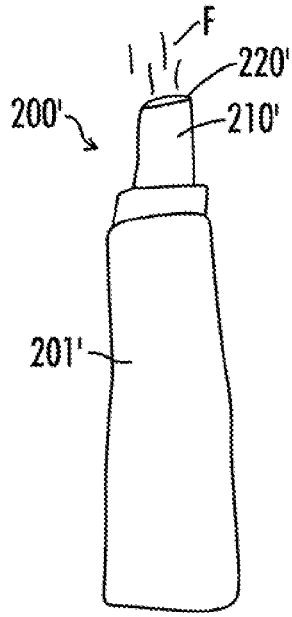
FIG. 21*b* is a side elevation of an alternate embodiment of a spreader outfitted with a spatula nozzle in accordance with the present invention.

FIG. 21*b* illustrates another embodiment of the present invention that combines a spatula and a spreader 200'. The spreader 200' includes a container 201', very similar to the container 201 above, that can hold a spreadable food F, such as peanut butter, butter, cheese, and the like. In a preferred embodiment of the present invention, the container 201' is flexible so as to allow a user to squeeze the spreadable food F. A spatula nozzle 210', which may be flexible, is attached to an open end of the container 201', and has an opening 220' to allow the spreadable food F to be transferred from the container 201' to an item such as bread, crackers, and the like. The knife nozzle 210' can then be used to spread the spreadable food F as desired.

Figure 22A:
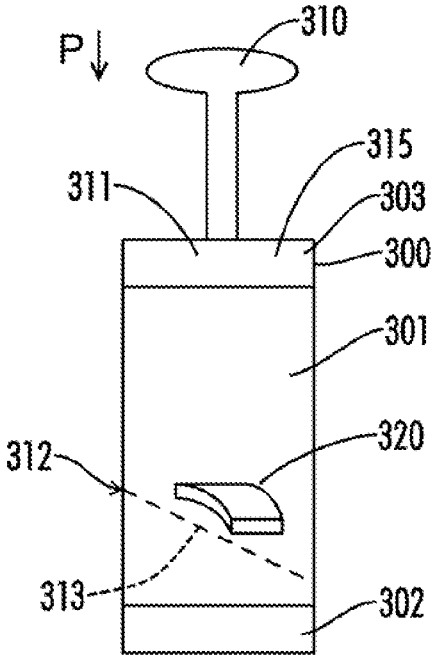
FIG. 22*a* is a front elevation view of an alternate embodiment of a spreader/dispenser in accordance with the present invention.
Figure 22B:
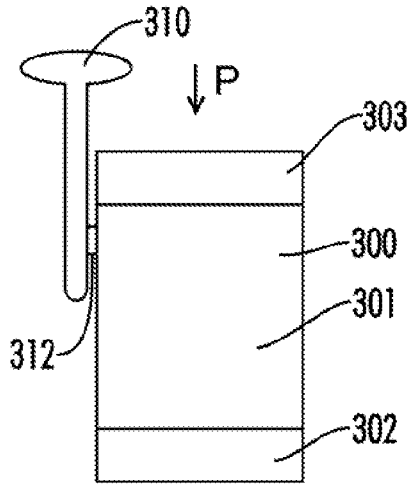
FIG. 22*b* is a partial front elevation view of the spreader/dispenser of FIG. 22*a* in an alternate configuration.

Referring now to FIGS. 22*a* and 22*b*, another embodiment of a spreader 300 is illustrated. The spreader 300 includes a container 301, having a base 302 and a lid 303, that can hold a spreadable food F, such as peanut butter, butter, cheese, and the like. A detachable handle 310 is mounted on the container 301 at an attachment point 312 for transport and storage, to allow the spreader 300 to have less of a profile and take up less room. A dispenser nozzle 320 is mounted on the exterior of the container 301 to allow for the spreadable food in the container to be pushed out and onto a receiving food, such as bread, crackers and the like. When the spreader 300 is to be used, the detachable handle 310 is detached from the attachment point 312 and is mounted at mounting point 311, where it comes into engagement with a plunger 315, located in the lid 303. Additionally, the dispenser nozzle 320 may be rotated up or down, or flipped up in order to facilitate dispensing or storage as the case may be. When the handle 310 is depressed in the direction of arrow 'P', then the handle 310 exerts downward pressure on the spreadable food in the container 301, and forces the spreadable food out of the dispenser nozzle 320, and onto the receiving food. The interior of the dispenser is beveled 313 to facilitate the removal of all material. While this embodiment has be described in the context of longitudinally thrust plunger, it is to be appreciated that other equivalent structures could fulfill this function. For example the plunger could be thrust downward by means of a screw activated compression mechanism.

Figure 23:
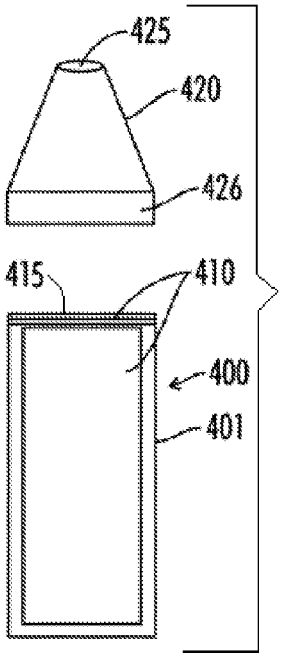
FIG. 23 is an exploded view of an alternate embodiment of a spreader and nozzle in accordance with the present invention.

Illustrated in FIG. 23 is another embodiment of a spreader 400. The spreader 400 includes a container 401 and a nozzle 420. The container includes a threaded end 426 and is capable of receiving a bag 410, which in turn holds a spreadable food such as peanut butter, butter, cheese, frosting, and the like. The bag 410 may be omitted altogether. The bag 410 is flexible in a preferred embodiment of the present invention and can be folded over the threaded end 415 of the container 401. The nozzle 420 includes an opening 425 and a threaded end 426 which threadedly engages the threaded end 426 of the container 401 to secure the nozzle 420 to the container 401. Additionally, the bag 410 is then secured into place as the overlap portion is secured between the threaded end 426 of the nozzle 420 and the threaded end 426 of the container 401.

Figure 24:
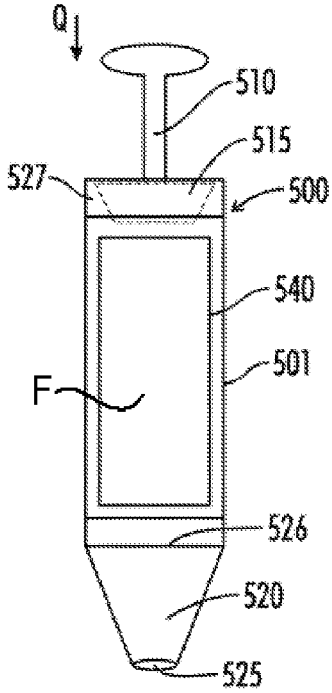
FIG. 24 is a front elevation view of an alternative embodiment of a spreader with nozzle and handle in accordance with the present invention.
Figure 25:
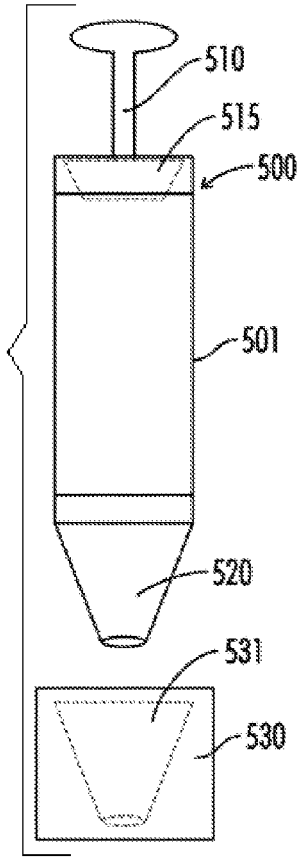
FIG. 25 is a front elevation view of the spreader of FIG. 24 shown with a cap for the nozzle.

Referring now to FIGS. 24 and 25, another embodiment of a spreader 500 is shown. The spreader 500 includes a container 501, and a wide nozzle 520. Disposed within the container 501 is a bag 540 that can hold a spreadable food F, such as peanut butter, butter, cheese, frosting, and the like. The wide nozzle 520 is mounted at an open end 526 of the container 501, and includes an opening 525. Mounted on the container 501, at the opposite end 527 is a handle 510. The handle 510 includes a plunger 515, such that when the handle 510 is depressed in the direction of arrow 'Q', the plunger 515 forces the spreadable food contained within the bag 540 out through the opening 525 of the wide nozzle 520 and onto a receiving food, such as bread, crackers, cake, and the like. Additionally, a cap 530, having a cavity 531 substantially in the shape of the wide nozzle 520, can be mounted on the container 501 at the wide nozzle 520 in order to allow the spreader 500 to be stored standing upright.

Figure 26:
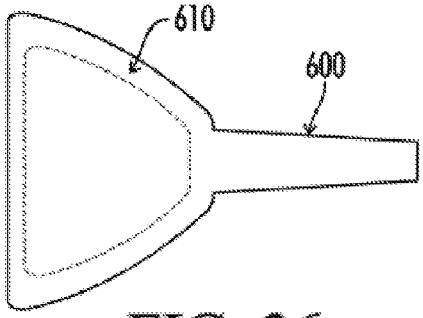
FIG. 26 is a further alternative embodiment of a nozzle.

FIG. 26 illustrates yet another embodiment of a nozzle in accordance with the present invention. In this embodiment, a rubber or flexible nozzle 600 is affixed to a threaded member 610 and extended coaxially thereto. The rubber/plastic nozzle 600 can function as a spreader.

Figure 27:
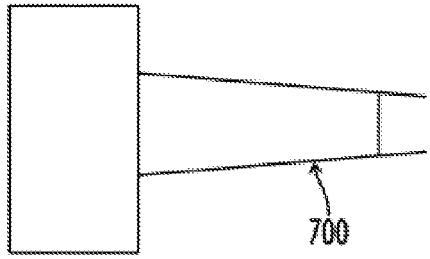
FIG. 27 is still yet a further embodiment of the nozzle of the present invention.

FIG. 27 is still a further embodiment of nozzles in accordance with the present invention. FIG. 27 illustrates a nozzle 700 which either may be stiff or comprise a member expandable in accordion style when pressure is applied.

Figure 28A:
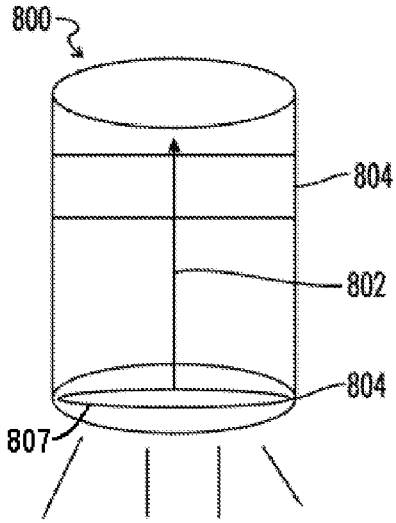
FIGS. 28*a*-28*b* are another embodiment of the nozzle spreader of the present invention.
Figure 28B:
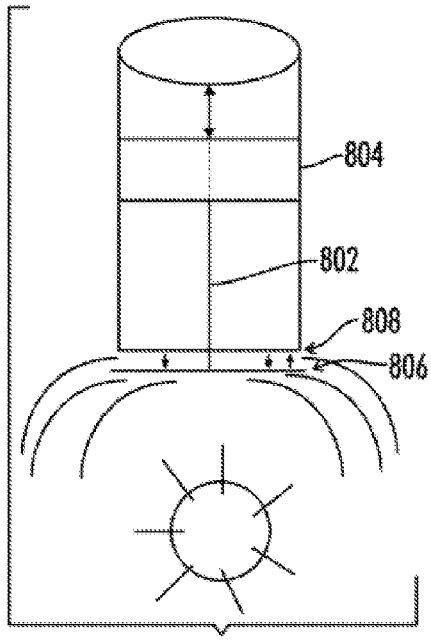

FIGS. 28*a* and 28*b* are still yet a further embodiment of a spreader in accordance with the present invention. In this embodiment, the spreader is a cylindrical casing 800 with an adjustable spine 802, connected to an adjustment mechanism 804 and nozzle 807 permit the flow of condiments such as spread dressing. It is to appreciated that the adjustment mechanism 804 may comprise a drive crew or other similar device to longitudinally move the nozzle 807. The nozzle 807 may have holes to permit the flow of material there through. When the adjustment mechanism, is 804 pulled upward the nozzle 807 pulls upward and permits the flow of material. When pressure is applied the nozzle extends stiffly outward. This embodiment is similar in its operation to a garden nozzle. In a modified embodiment shown in FIG. 28*b*, the mechanism can have two positions, "on" and "off" 806, 808.

Figure 29:
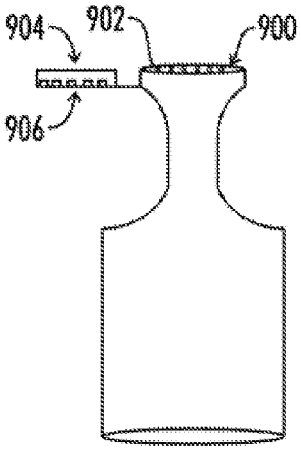
FIGS. 29 and 29*a* are another embodiment of the nozzle spreader of the present invention.
Figure 29A:
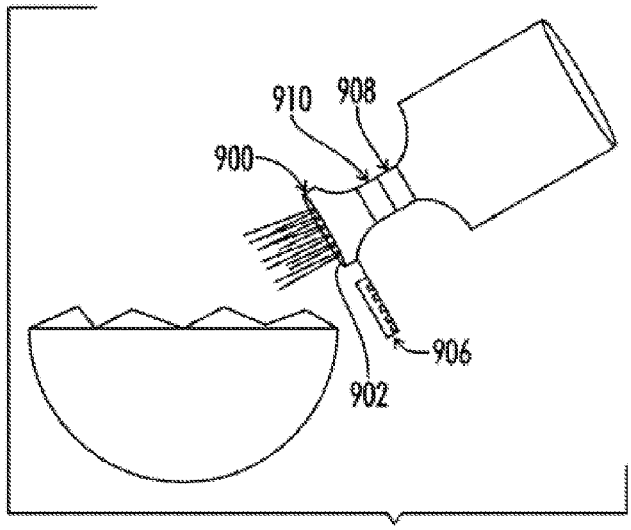

FIGS. 29 and 29*a* illustrate yet another nozzle spreader embodiment. In this embodiment, the nozzle spreader comprises a flat, wide nozzle 900 having a plurality of shaped holes 902. The nozzle can have a flip cap 904, for example, and may have a cap or closure which has protrusions 906 to cover the holes. This embodiment is ideal for salad dressings or the like. As shown in FIG. 29*a*, the bottle can have a threaded attachment 908 and adjuster 910 to adjust the flow of material.

Figure 30:
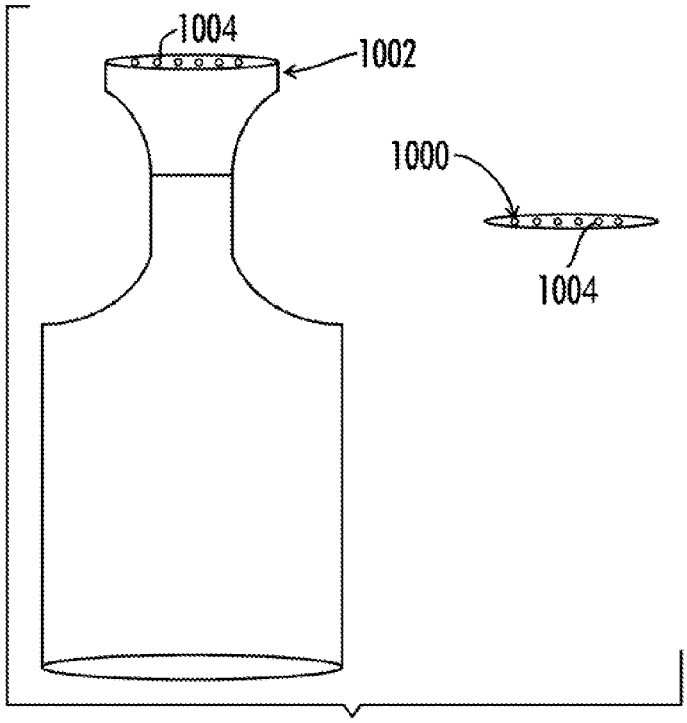
FIG. 30 is another embodiment of the nozzle spreader of the present invention.

FIG. 30 is a related embodiment to that of FIG. 29. In this embodiment, the nozzle comprises a flat, wide nozzle 1000 that inserts on a wide flange top 1002. The nozzle has a plurality of holes 1004 which may be beveled outward. The number, shape and position of the holes can be varied. This embodiment is ideal, for example, for ice cream toppings and salad dressings and other viscous food products. In a preferred embodiment, this bottle is a unitary structure including the novel flange top.

Figure 31:
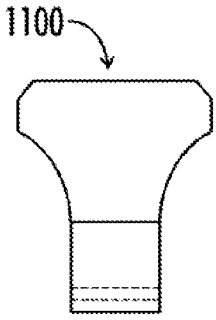
FIGS. 31 and 31*a* are another embodiment of the nozzle spreader of the present invention.
Figure 31A:
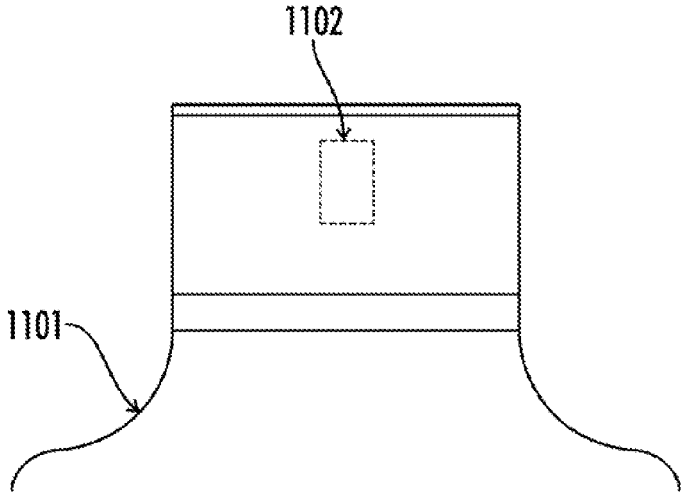

Finally, FIGS. 31 and 31*a* illustrate yet another nozzle embodiment. In this embodiment, the nozzle/spreader comprises a wide but narrow slit flange 1100 which is affixed to the bottle or tube 1101. The corners of the nozzle can be straight or cornered. This embodiment may include an internal support or stilt 1102 to prevent the nozzle from collapsing.

In view of the foregoing disclosure, some advantages of the present invention can be seen. For example, a novel spreader has been disclosed. The novel spreader easily, quickly and accurately spreads material such as edible substances, being dispensed from containers such as squeeze tubes or bottles.

Figure 32A:
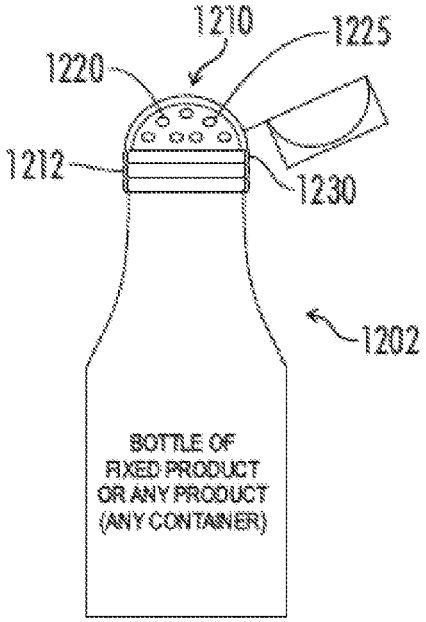
FIGS. 32*a*-32*c* is yet another embodiment of the present invention which includes a dome-shaped configuration.
Figure 32B:
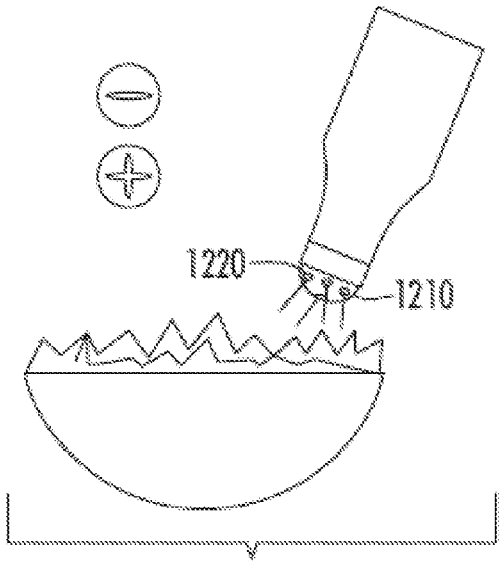
Figure 32C:
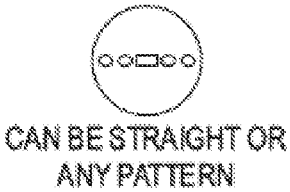

Referring to FIGS. 32*a* to 32*c*, alternative embodiments of the spreader dispenser of this present invention for viscous materials, salad dressings, mustard, ketchup, taco sauce, ice cream toppings, syrups and other semi-liquid and squeezable products. As seen in FIGS. 32*a* and 32*b*, the invention includes a bottle of food product 1202 containing a dome-shaped spreader/applicator 1210. The dome-shaped spreader/applicator 1210 has an outer lip 1212 which snaps onto the container neck to hold it secure. The dome-shaped spreader 1210 has a plurality of apertures or orifices 1220 which are position angle outward so that the dispensed product spreads out evenly when applied. The dome application thus functions to spread out the food product in a wide array and with uniformity. The orifices 1220 of the dome 1210 can be straight (in line) (FIG. 32*c*) or may be dispensed over the body of the dome 1225. In one embodiment the dome-shaped spreader 1210 may have internal threads 1230, which enables the lid to securely attach to the top of the bottle by screwing it on, snapping it on, or alternatively by affixing it by any other mechanism or instrumentality.

Figure 33A:
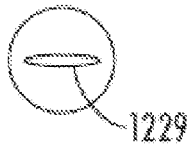
FIGS. 33*a* and 33*b* illustrate the slit openings of the present invention.
Figure 33B:
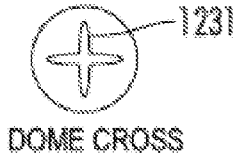

Referring to FIGS. 33*a* and 33*b*, the orifice's dome-shaped spreader 1220 may have slits 1229 or a plurality of cross-slits 1231 instead of fully open apertures or orifices. It is to be appreciated that the holes where the product emerges, can have a plurality of diameters or shapes and any geometric configuration.

Figure 34B:
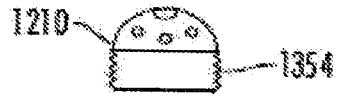
FIGS. 34*a*-34*b* illustrate yet another alternative embodiment in which the dome-shape application is inserted into the throat of the bottle.
Figure 34A:
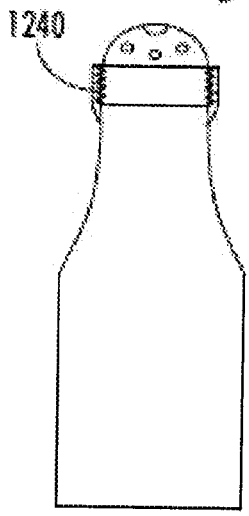

Referring to FIGS. 34*a* and 34*b*, an embodiment is illustrated in which the dome-shaped spreader/applicator 1210 is placed within the inside lip of the bottle 1240. The spreader/applicator is held in place by a number of mechanisms, including threads or snaps. The dome in this embodiment fits proximate to the bottle top and has an annular serrated ridge 1354 which fits on the inside of the bottle. The dome can also be screwed into the bottle or secured using a variety of mechanical attachment systems.

Figure 35A:
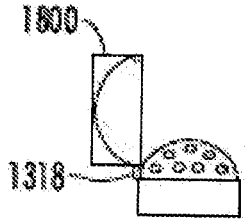
FIGS. 35*a*-35*e* are perspective views of caps which are over the dome of the present invention.
Figure 35B:
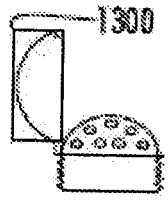
Figure 35C:
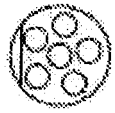
Figure 35D:
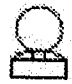
Figure 35E:
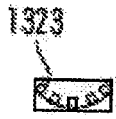

FIGS. 35*a*-35*e* illustrate caps 1300 which fit over the dome-shaped spreader. The present invention displays a number of cap embodiments. As shown in FIG. 35*a*, a first cap embodiment comprises a dome-shaped nozzle cap which is attached by a living hinge 1318. It can also be separate from the bottle. As shown in FIG. 35*e*, the cap can comprise a male closure with matching prongs 1323 which cover over the orifices. This prevents clogging of the holes by dried product.

Figure 36A:
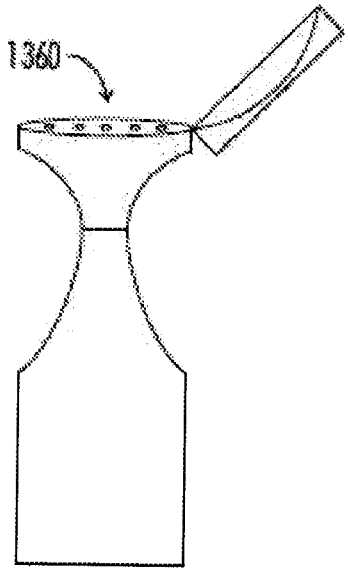
FIGS. 36*a* and 36*b* illustrate another embodiment of a flange-shaped dome closure system for use in the present invention.
Figure 36B:
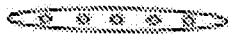
Figure 36C:
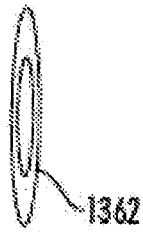
Figure 37A:
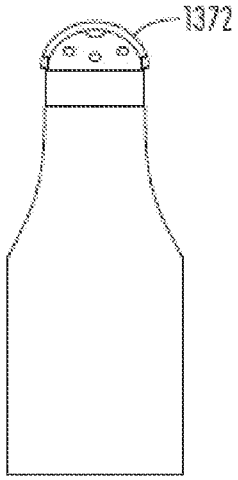
FIGS. 37*a* through 37*f* illustrate a dial-type dome applicator/spreader in accordance with the present invention.
Figure 37B:
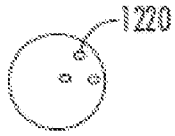
Figure 37C:
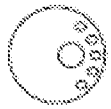
Figure 37D:
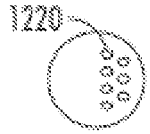
Figure 37E:
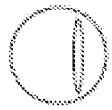
Figure 37F:
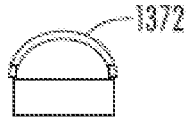

FIGS. 36*a* to 36*c* illustrate an embodiment of the dome-shaped nozzle applicator 1360 which corresponds to the wide flange embodiment of FIG. 30. Here the oval-shaped applicator 1360 is dome-shaped and a corresponding cap is dome-shaped and is designed to fit on the bottle. The dome can fit inside or outside of the bottle as shown in FIGURES. Alternatively, the dome-shaped applicator 1360 can have slits, crosses or other aperture shapes 1362 as shown in FIG. 36*c*.

FIGS. 37(*a*)-(*f*) illustrates yet a further embodiment of the present invention. In this embodiment the dome-shaped applicator has a rotating dial cover 1372 which permits the apertures or orifices 1220 to be selectively opened and closed. By rotating the dial in one direction the orifices are open and product can flow. When rotated in the other direction the orifices 1220 are closed. The orifices can have any shape, size or configuration.

Figure 38:
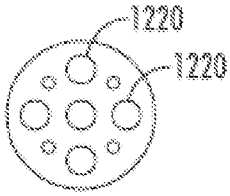
FIG. 38 illustrates a dome having a plurality of orifices having different sizes.

FIG. 38 illustrates a dome having a plurality of orifices having different shapes, sizes and orientation. The different sized orifices 1220 allow the passage of different sized chunks or pieces (e.g. "Thousand Island" salad dressing).

Figure 39:
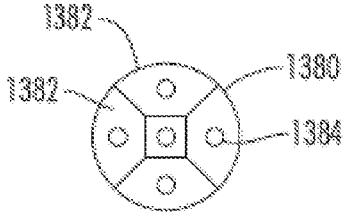
FIG. 39 illustrates an embodiment in which the dome is pyramid sloped.

FIG. 39 illustrates yet another embodiment of the invention in which the applicator has the shape of a flattened, four sided pyramid 1380 instead of a curved shape. Each side 1382 has a plurality of orifices 1384. It is to be noted that the pyramid embodiment can have more than four sides (e.g. 6,8, 10, etc.). The invention also suggests additional embodiments besides pyramid shapes.

Figure 40:
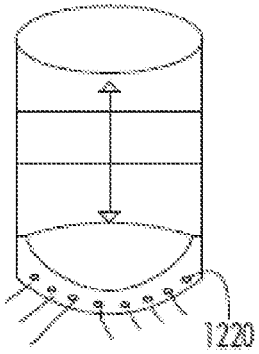
FIG. 40 illustrates an alternative nozzle embodiment of the present invention having a dome-shaped applicator.

FIG. 40 is an embodiment which corresponds with the nozzle embodiment of FIG. 28. In this embodiment, the dome-shaped applicator is affixed to the end of the cylindrical nozzle casing and permits product to flow through the orifices 1220.

Figure 41A:
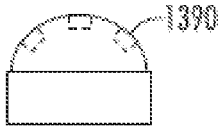
FIG. 41 illustrates alternative orifice embodiments.
Figure 41B:
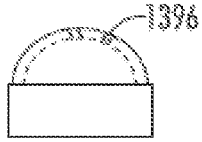
Figure 41C:
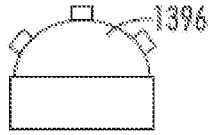

Referring to FIGS. 41*a* to 41*c*, alternative orifice configurations are shown. The orifices can be indented 1390 into the bottle. They can also face or protrude outward 1394. They can be contiguous with the dome 1396. The strength and pliability of the plastic, impacts the types of food to be used and the amount of pressure that needs to be applied.

Figure 42A:
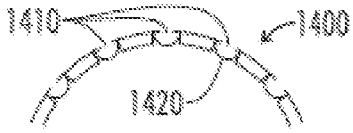
FIG. 42 illustrates a nipple-based embodiment for use in the preferred embodiment.
Figure 42B:
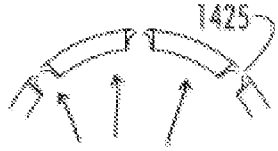
Figure 43A:
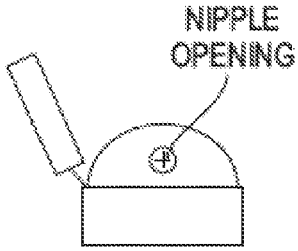
FIG. 43 are views of nipple embodiments of the present invention.
Figure 43B:
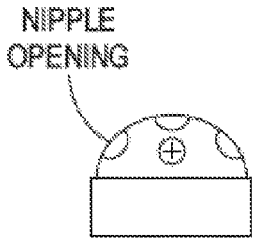
Figure 43C:
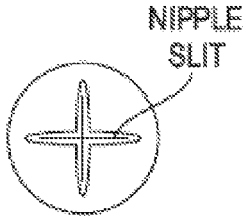
Figure 43D:
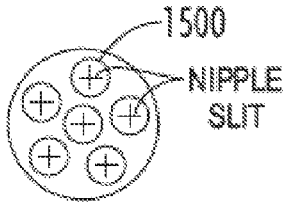
Figure 43E:
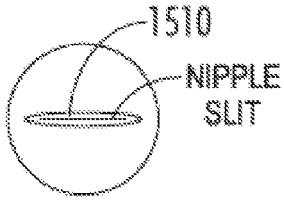

Referring now to FIGS. 42*a* and 42*b*, a still further embodiment is shown and described. This embodiment comprises an applicator with a plurality of nipple openings 1400. The embodiment comprises a plurality of flexible nipple inserts 1410. The flexible nipple inserts 1410 are indented inwardly 1420 into the bottle and they are forced outwardly 1425 when the product is squeezed out.

FIGS. 43*a* to 43*e* shows a number of dome-shaped embodiments which illustrate the use of nipples. The nipples are shown as having a cross or X-shaped orifices 1500 as well as slits 1510. The nipple embodiment can be utilized with any of the embodiments shown in FIGS. 1 to 31.

Figure 44:
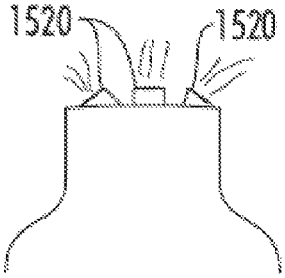
FIG. 44 is an embodiment of the invention in which the orifices are angled.

FIG. 44 illustrates an embodiment of the present invention in which the orifices are angled 1520. This embodiment permits product to be dispensed in a wide variety of directions.

Figure 45A:
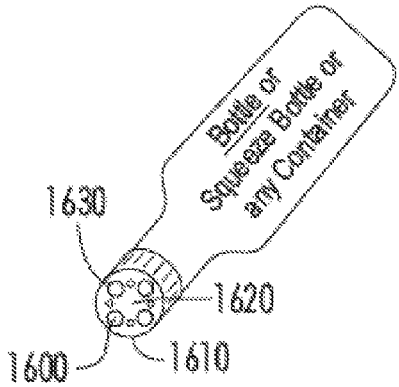
FIGS. 45*a* and 45*b* illustrate another dial-type embodiment.
Figure 45B:
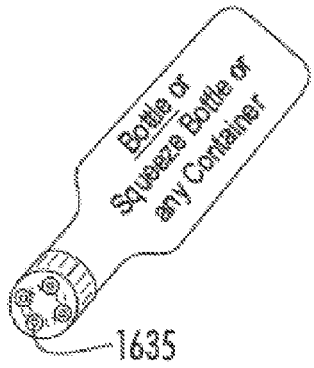

Finally, FIGS. 45*a* and 45*b* illustrate another embodiment in which the applicator 1600 has two sets of orifices. A four-holed dial 1610 can then be rotationally affixed over the applicator 1620. When the dial is turned in a first direction, the large orifices 1630 align with the dial. When turned in a second direction, the small orifices 1635 align. A third position closes the orifices. This embodiment facilitates two levels of product application flow.

While the preferred embodiment of the present invention has been described and illustrated, modifications may be made by one of ordinary skill in the art without departing from the scope and spirit of the invention as defined in the appended claims. For example, in a preferred embodiment of the present invention, the bags 410 and 540 may be polybags, however, the bags may be of any type known to one of ordinary skill in art. Additionally, the method of securing the nozzles to the containers has been described and illustrated as being via a threaded engagement. However, a skilled artisan may employ any appropriate means to attach the nozzles to the containers, such as, but not limited to, a snap connection or molded piece.

In addition, while the invention has been principally described in the context of food, it is to be appreciated that the applicator and spreader of the present invention may be applicable to non-food products. Nonexclusive examples include caulks, pastes, glues and building materials and automotive products such as waxes, greases, etc.

The invention claimed is:

1. A nozzle for attachment to a dispenser for dispensing material, the nozzle comprising:

a) a fitting at a first end to facilitate attachment to the dispenser;

b) an opening at a second end opposite the first end through which material is dispensed, the fitting being wider than the opening, the opening defining a periphery having a lateral width dimension and a height dimension, the opening further comprising arcuate and concave surfaces at widthwise opposite ends that remain of fixed dimension to define an oval periphery, the lateral width dimension substantially exceeding twice the height dimension of the opening; and c) a forwardly-projecting side wall extending from the first end to the opening, the side wall having a peripheral outer surface defined by a concave surface that transitions into a convex surface that terminates at the opening;

d) wherein the side wall further comprises an upper wall and a lower wall, each of the upper and lower walls comprising a portion of the peripheral outer surface such that each of the upper and lower walls comprises a concave surface that transitions into a convex surface terminating at the opening, e) whereby a substantially constant layer of material is dispensed through the opening and having a width of the opening.

2. A nozzle in accordance with claim 1, wherein the height dimension remains substantially constant throughout the lateral width extent of the opening.

3. A nozzle in accordance with claim 2, wherein the convex surface of the upper wall has a curvature that is substantially the same as that of the convex surface of the lower wall.

4. A nozzle in accordance with claim 3, wherein the concave surface of the upper wall has a curvature that is substantially the same as that of the concave surface of the lower wall.

5. A nozzle in accordance with claim 4, wherein a center of the opening is located along a central axis of the nozzle.

6. A nozzle in accordance with claim 2, wherein the convex surface of the upper wall has a curvature that is substantially the same as that of the convex surface of the lower wall.

7. A nozzle in accordance with claim 1, further comprising a cap for covering the opening.

8. A nozzle in accordance with claim 7, wherein the cap further comprises a plug for plugging the opening.

9. A nozzle in accordance with claim 8, wherein a portion of the cap extends around the opening.

10. A nozzle in accordance with claim 8, wherein a portion of the plug extends into the opening.

11. A nozzle in accordance with claim 1, wherein the fitting is threaded.

12. A nozzle in accordance with claim 11, further comprising a compressible dispenser attached to the nozzle.

13. A nozzle in accordance with claim 1, further comprising a compressible dispenser attached to the nozzle.

* * * * *

US007325994C1

(12) INTER PARTES REEXAMINATION CERTIFICATE (0269th)

United States Patent

Liberatore

(10) Number: US 7,325,994 C1

(45) Certificate Issued: May 31, 2011

(54) SPREADER

(75) Inventor: Raymond A. Liberatore, Bentonville, AR (US)

(73) Assignee: Mack-Ray, Inc., Bentonville, AR (US)

Reexamination Request:

No. 95/000,388, Aug. 6, 2008

No. 90/010,208, Jun. 23, 2008

Reexamination Certificate for:

| | |
|---|---|
| Patent No.: | **7,325,994** |
| Issued: | **Feb. 5, 2008** |
| Appl. No.: | **10/894,428** |
| Filed: | **Jul. 19, 2004** |

Related U.S. Application Data

(63) Continuation-in-part of application No. 10/810,485, filed on Mar. 26, 2004, now Pat. No. 7,314,328, and a continuation-in-part of application No. 10/750,447, filed on Dec. 30, 2003, now Pat. No. 7,226,230, and a continuation-in-part of application No. 10/628,097, filed on Jul. 28, 2003, now abandoned.

(51) Int. Cl.

| | |
|---|---|
| ***B05C 11/00*** | (2006.01) |
| ***B43K 1/06*** | (2006.01) |
| ***B43K 23/12*** | (2006.01) |
| ***B43M 11/06*** | (2006.01) |
| ***B65D 25/40*** | (2006.01) |

(52) U.S. Cl. ..... 401/266; 401/265; 401/262; 401/183; 222/566

(58) Field of Classification Search ..... None
See application file for complete search history.

(56) References Cited

U.S. PATENT DOCUMENTS

| | | | | |
|---|---|---|---|---|
| 2,014,149 A | * | 9/1935 | Stafford | 401/264 |
| 5,381,935 A | | 1/1995 | Mock | |

FOREIGN PATENT DOCUMENTS

| | | |
|---|---|---|
| CA | 976113 | 10/1975 |
| WO | WO 01/96198 A1 | 12/2001 |
| WO | 01/96198 | 12/2001 |

* cited by examiner

*Primary Examiner*—Joseph A. Kaufman

(57) ABSTRACT

Apparatus for use with a hand manipulable flowable material dispenser, the combination comprising a dispensing nozzle associated with the dispenser to dispense material, and a spreader surface associated with the nozzle whereby the dispenser may be manipulated to cause the spreader surface to spread material dispensed via the nozzle, and the spreader surface can be used to spread material around after it is dispensed.

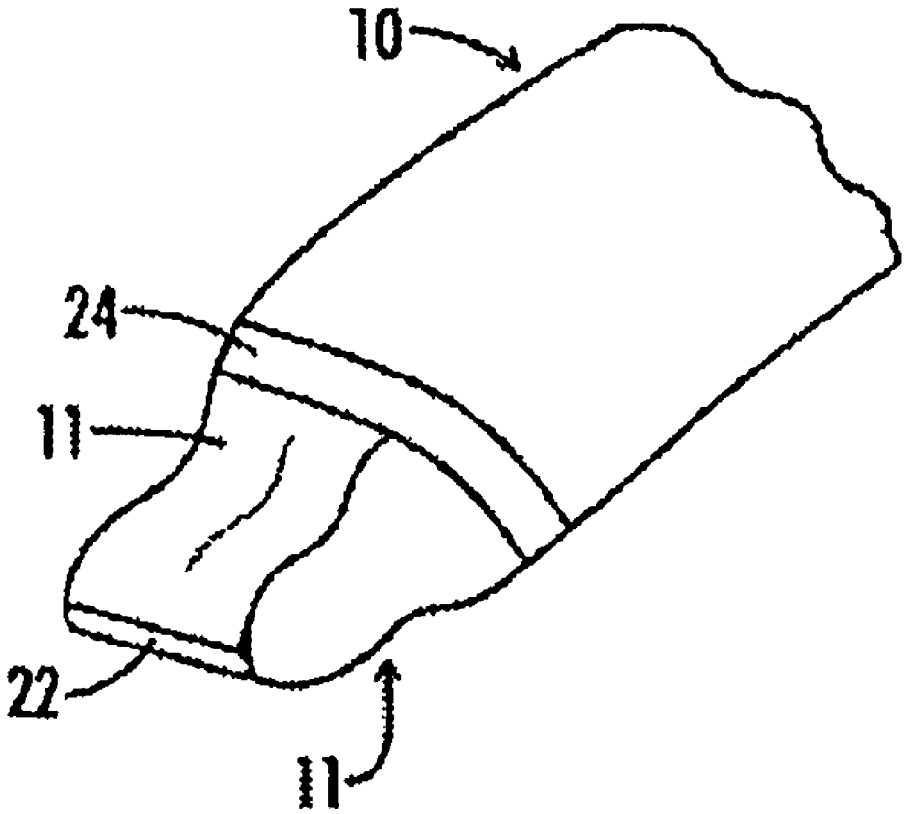

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1-13 is confirmed.

* * * * *